US005857795A

United States Patent [19]

Liou

[11] Patent Number: 5,857,795

[45] Date of Patent: Jan. 12, 1999

[54] PAINT ROLLER DEVICE

[76] Inventor: Sam Foo Liou, 5F-23, 70, Fu-Shing Road, Taoyuan, Taiwan

[21] Appl. No.: 963,027

[22] Filed: Nov. 3, 1997

[51] Int. Cl.[6] ..... B43M 11/02

[52] U.S. Cl. ..... 401/218; 401/208; 101/330

[58] Field of Search ..... 401/218; 101/350.1, 101/330; 107/330

[56] References Cited

U.S. PATENT DOCUMENTS 3,148,402 9/1964 Garabon ..... 401/218

5,702,525 12/1997 Liou ..... 401/218

*Primary Examiner*—Robert M. Fetsuga

*Assistant Examiner*—Tuan N. Nguyen

*Attorney, Agent, or Firm*—Dougherty & Troxell

[57] ABSTRACT

A paint roller device including a holder frame with a handle, a paint container, a paint feeding roller, a paint distribution roller, and a painting roller, wherein the paint container has two hangers respectively hung on two round rods of the holder frame and turned with the paint container within a limited angle confined between locating pins on the holder frame; torsional springs are coupled between the painting roller and the holder frame to force the painting roller apart from the paint distribution roller; the painting roller has a felt cover layer on a foam cover thereof, the felt cover layer bilaterally projecting over two opposite sides of the holder frame for painting corner area on the workpiece.

1 Claim, 6 Drawing Sheets

PAINT ROLLER DEVICE

BACKGROUND OF THE INVENTION

The present invention relates to paint roller devices, and more particularly to such a paint roller device which prevents the user's hand from touching the paint container during painting and, which can effectively paint corner area on the workpiece.

U.S. patent Ser. No. 08/695,894 which was an invention of the present inventor, discloses an improved paint roller device. This structure of paint roller device is generally comprised of a holder frame with a handle for holding, a paint container hung on the holder frame, a paint feeding roller revolvably mounted in the paint container and turned to carry the contained paint out of the paint container, a painting roller coupled to the holder frame and turned to apply the paint to the workpiece, and a paint distribution roller adapted to distribute the paint from the paint feeding roller over the painting roller. This structure of paint roller device is functional, however it still has drawbacks. Because the painting roller and the paint distribution roller are maintained in contact with each other, the painting roller cannot be pushed away from the paint distribution roller during a finishing operation where no further paint is needed. Another drawback of this structure of paint roller device is that the two opposite ends of the holder frame tend to hinder the operation of the painting roller when painting a corner area on the workpiece. Still another drawback of this structure of paint roller is that the user's hand may touch the paint container to hinder the painting operation when turning the handle downwards.

SUMMARY OF THE INVENTION

The present invention has been accomplished to provide a paint roller device which eliminates the aforesaid said drawbacks. According to one aspect of the present invention, the holder frame of the paint roller device comprises two round rods symmetrically raised from two opposite sides thereof, and two pairs of locating pins symmetrically raised from its two opposite sides adjacent to said round rods; the paint containers comprises two metal hangers revolvably hung on the round rods of the holder frame, each metal hanger having a stop portion at the top suspended between one pair of locating pins on the U-shaped holder frame to limit the turning angle of the paint container relative to the holder frame. According to another aspect of the present invention, torsional springs are coupled between the holder frame and the painting roller to impart a forward pressure to the painting roller, causing the painting roller to be moved apart from the paint distribution roller. According to still another aspect of the present invention, the painting roller comprises a roller frame covered with a foam cover, the foam cover having a felt cover layer, the felt cover layer projecting over two opposite ends of the roller frame and having a length longer than the distance between the two coupling end pieces of the U-shaped holder frame convenient for painting a corner area on the workpiece.

DETAILED DESCRIPTION OF THE PREFERRED EMBODIMENT

Figure 1:
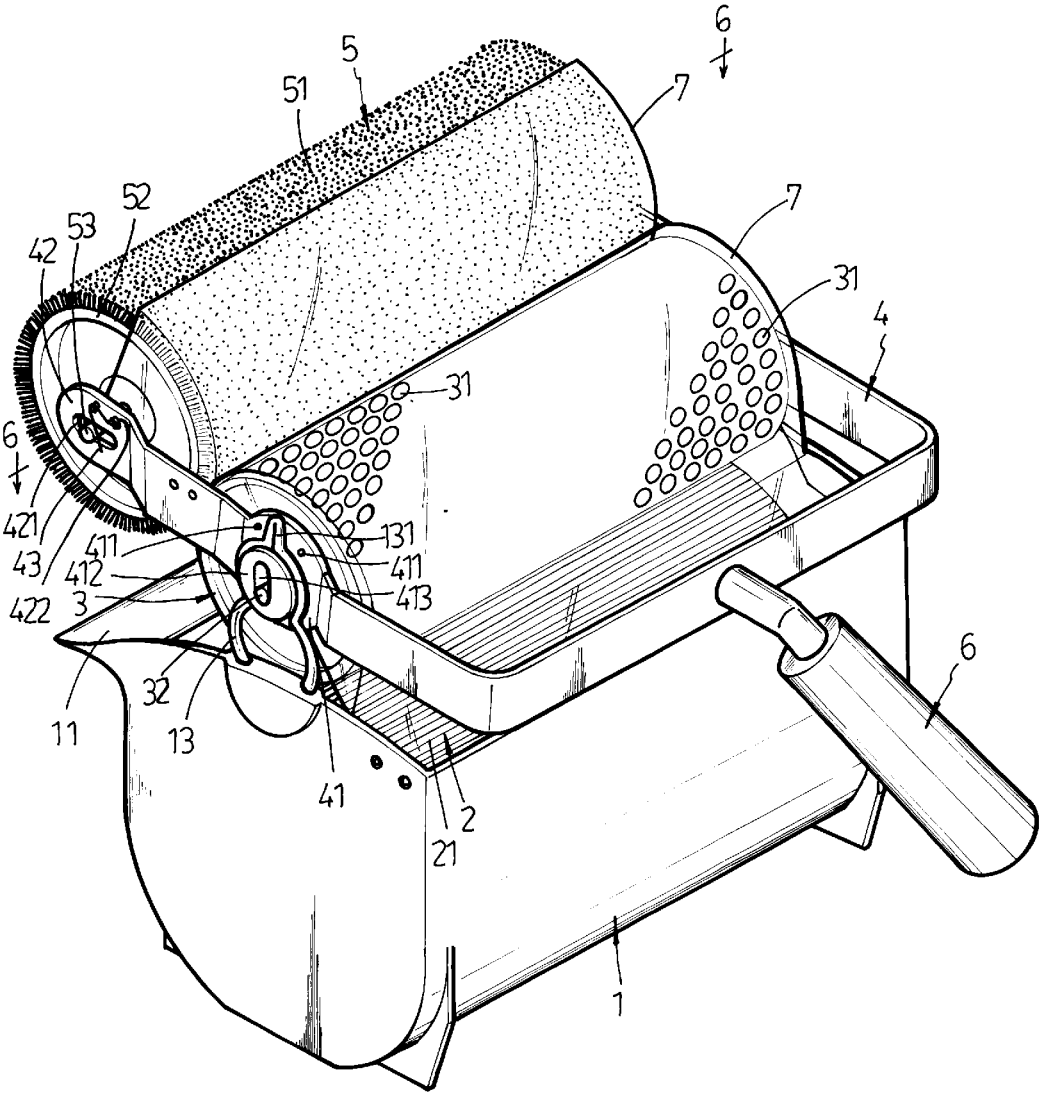
FIG. 1 is a perspective view of a paint roller device according to the present invention.
Figure 2:
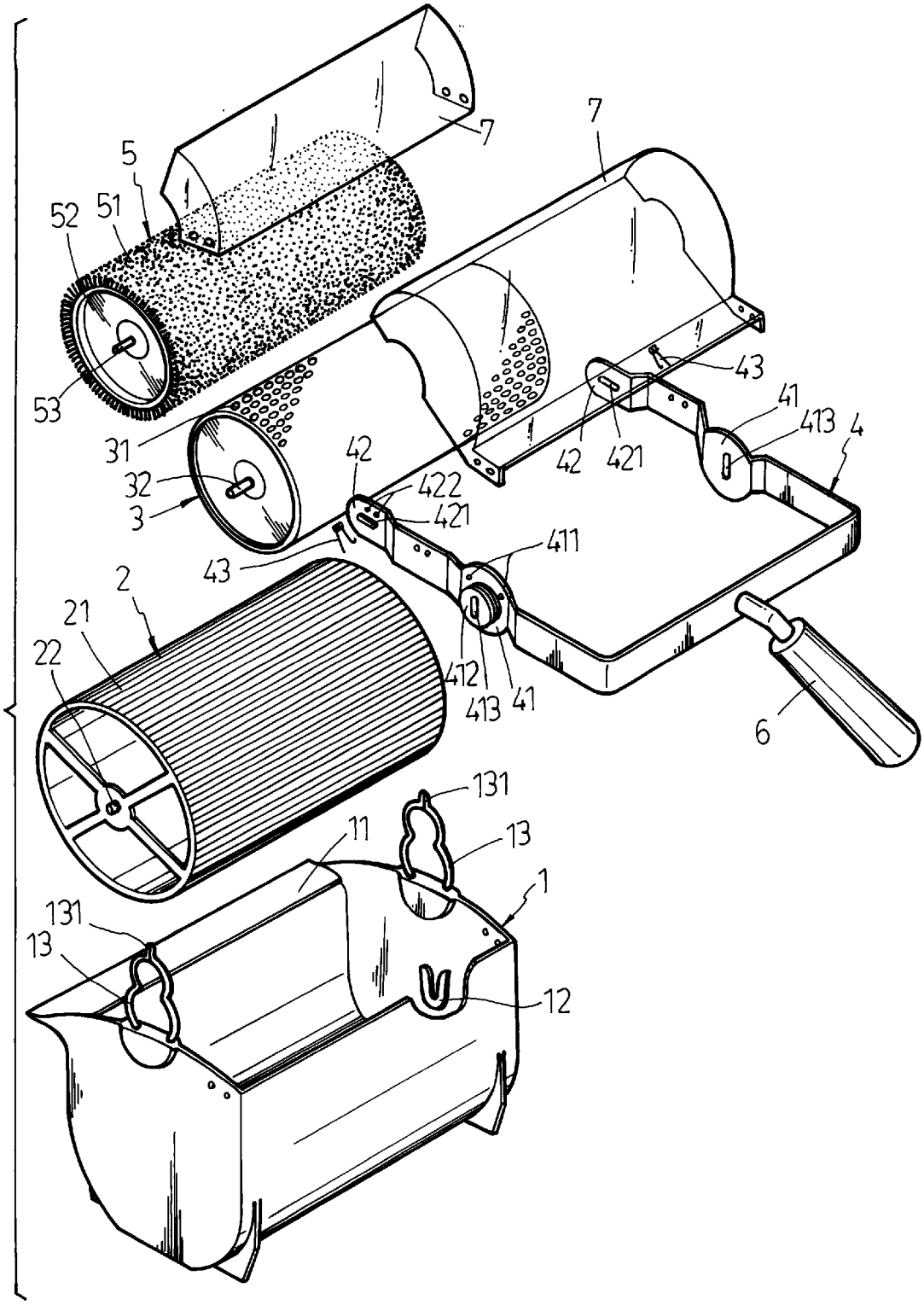
FIG. 2 is an exploded view of the paint roller device shown in FIG. 1.

Referring to FIGS. 1 and 2, a paint roller device in accordance with the present invention is generally comprised of a paint container 1, a paint feeding roller 2, a paint distribution roller 3, a U-shaped holder frame 4, a painting roller 5, and a handle 6.

The paint container 1 is a top-open container made from metal and holding a paint 8, comprising a front baffle 11 adapted to prevent paint from flowing out of the paint container 1 when shaking, two bearing blocks 12 bilaterally disposed on the inside and adapted to hold the paint feeding roller 2, two hangers 13 bilaterally raised from the top and respectively spaced above the bearing blocks 12 and adapted for coupling to the U-shaped holder frame 4. The hangers 13 are respectively made by bending a metal wire rod into shape and then welding the shaped metal wire rod to the paint container 1. Each hanger 13 has a top end terminating in a stop portion 131. The paint feeding roller 2 is covered with a longitudinally grooved roller cover 21, having two pivots 22 raised from two opposite ends thereof at the center and respectively coupled to the bearing blocks 12 of the paint container 1. The handle 6 is fixedly connected to the U-shaped holder frame 4. The U-shaped holder frame 4 comprises two recessed portions 41 bilaterally disposed on the middle, two round rods 412 respectively raised from the recessed portions 41 in reversed directions and respectively coupled to the hangers 13 of the paint container 1, two transversely extended oblong slots 413 respectively pierced through the longitudinal central axes of the round rods 412 and the recessed portions 41, two pairs of first locating pins 411 respectively raised from the recessed portions 41 outside the round rods 412, two coupling end pieces 42 at its two opposite ends, two longitudinally extended oblong slots 421 respectively disposed at the coupling end pieces 42, and two pairs of second locating pins 422 respectively raised from the coupling end pieces 42 above the longitudinally extended oblong slots 421. The paint distribution roller 3 is covered with an embossed roller cover 31, having two pivots 32 raised from two opposite ends thereof at the center and respectively coupled to the transversely extended oblong slots 413. The painting roller 5 is covered with a foam cover 52, which has a felt outside layer 51, having two pivots 53 raised from two opposite ends thereof at the center and respectively coupled to the longitudinally extended oblong slots 421 of the holder frame 4. When the pivots 32 of the paint distribution roller 3 are respectively coupled to the transversely extended oblong slots 413 of the holder frame 4, the paint distribution roller 3 can be moved up and down within the limitation of the transversely extended oblong slots 413. When the pivots 53 of the painting roller 5 are respectively coupled to the longitudinally extended oblong slots 421 of the holder frame 4, the painting roller 4 can be moved back and froth within the limitation of the longitudinally extended oblong slots 421. When the paint roller device is assembled, the paint distribution roller 3 is revolvably retained between the painting roller 5 and the paint feeding roller 2.

Figure 3:
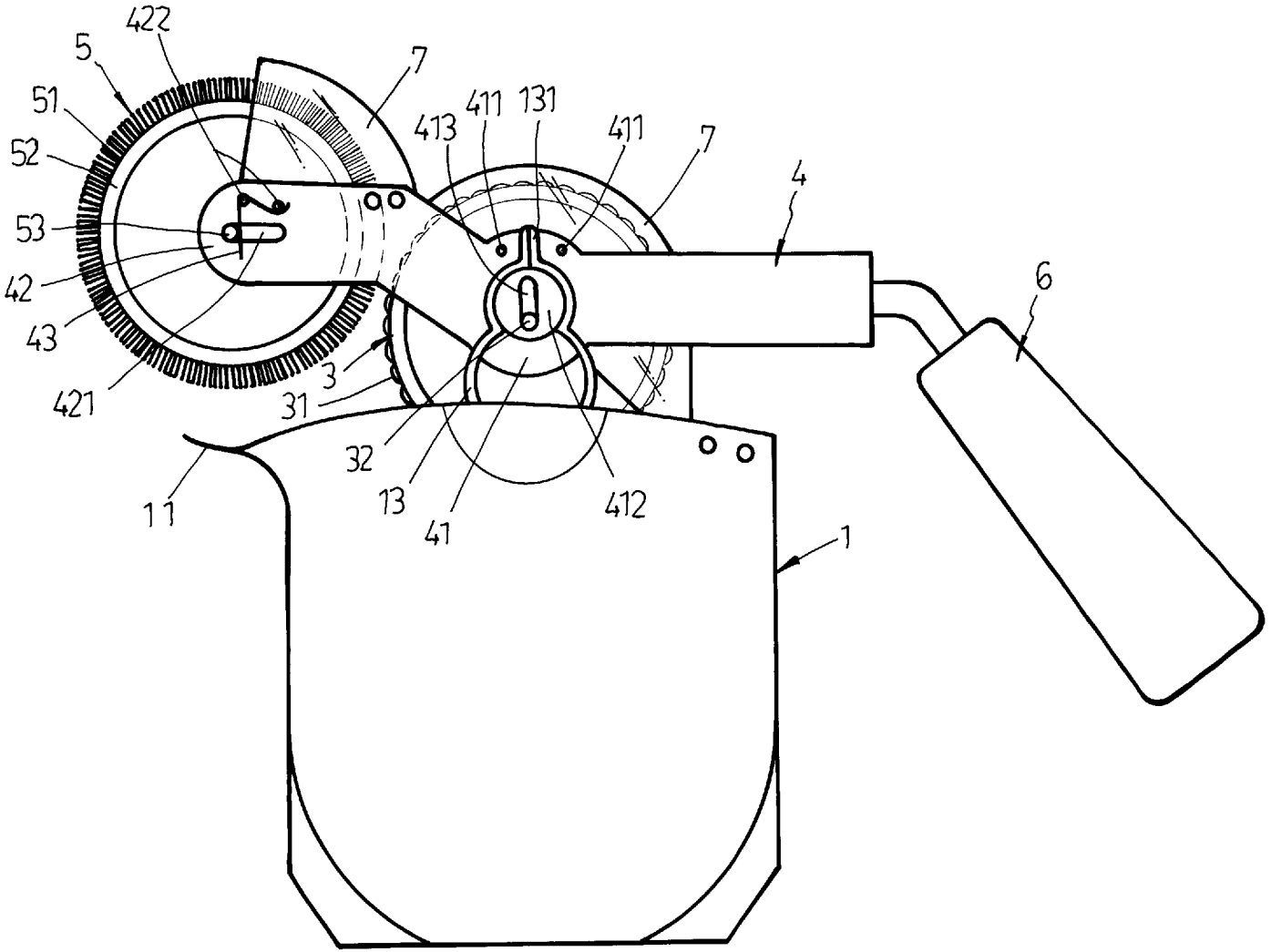
FIG. 3 is a side plain view of the paint roller device shown in FIG. 1.

Referring to FIG. 3, two torsional springs 43 are respectively mounted on the second locating pins 422 of the holder frame 4 and the pivots 53 of the painting roller 5. The torsional springs 43 impart a forward pressure to the painting roller 5, causing the painting roller 5 to be moved forwardly away from the paint distribution roller 3. Therefore, the paining roller 5 is maintained in contact with the paint distribution roller 3 only when the paint roller device is pressed against the wall to be paint and moved.

Figure 4:
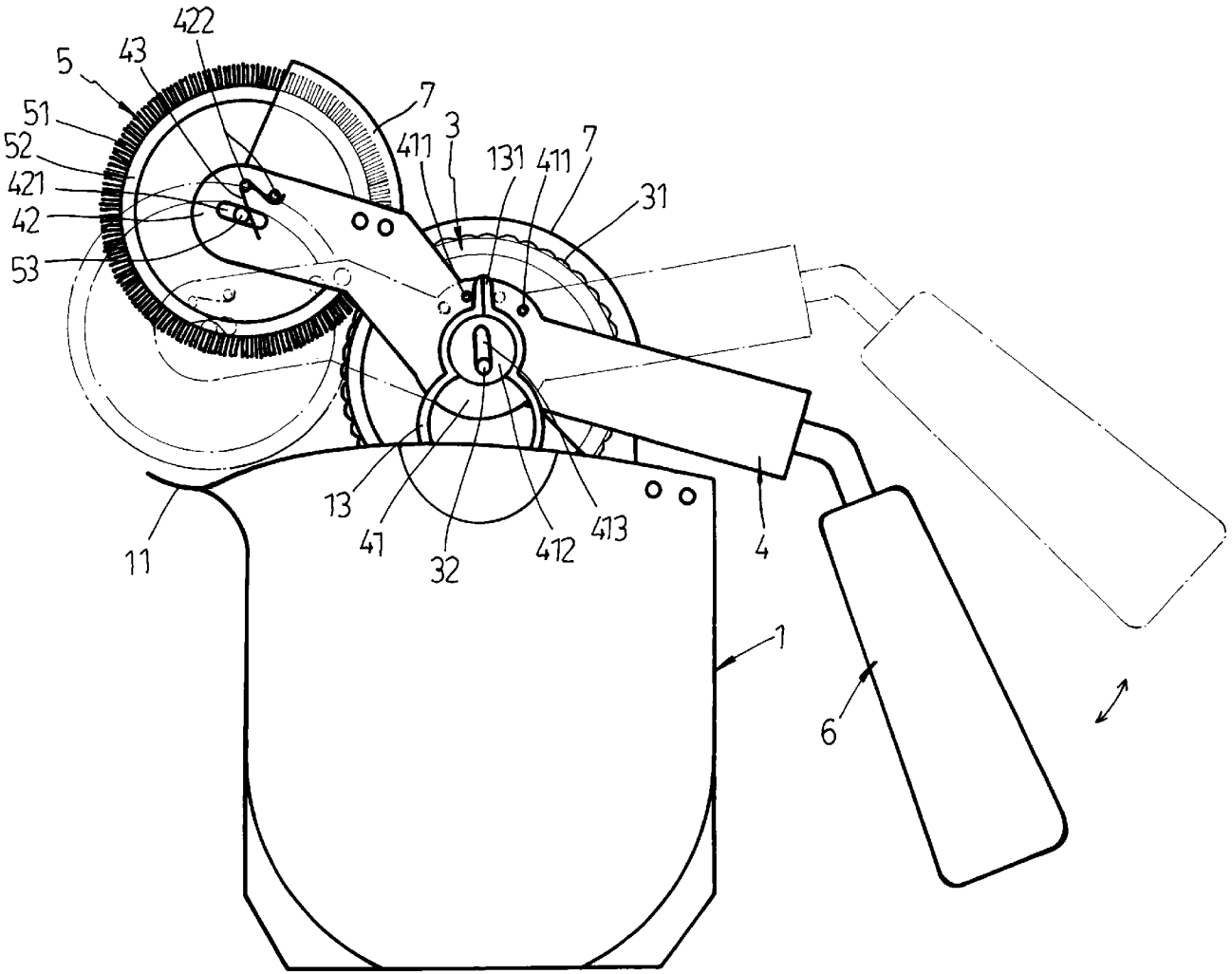
FIG. 4 is an applied view of the present invention, showing the limited turning angle of the holder frame relative to the paint container.

Referring to FIG. 4, when the paint container 1 is coupled to the holder frame 4, the stop portion 131 of each hanger 13 is suspended in between the respective pair of first locating pins 411 to limit the turning angle of the paint container 1 relative to the holder frame 4. Therefore, the user's hand does not touch the paint container 1 when turning the handle 6 downwards; the painting roller 5 does not touch the baffle 11 of the paint container 1 when turning the handle 6 upwards.

Figure 5:
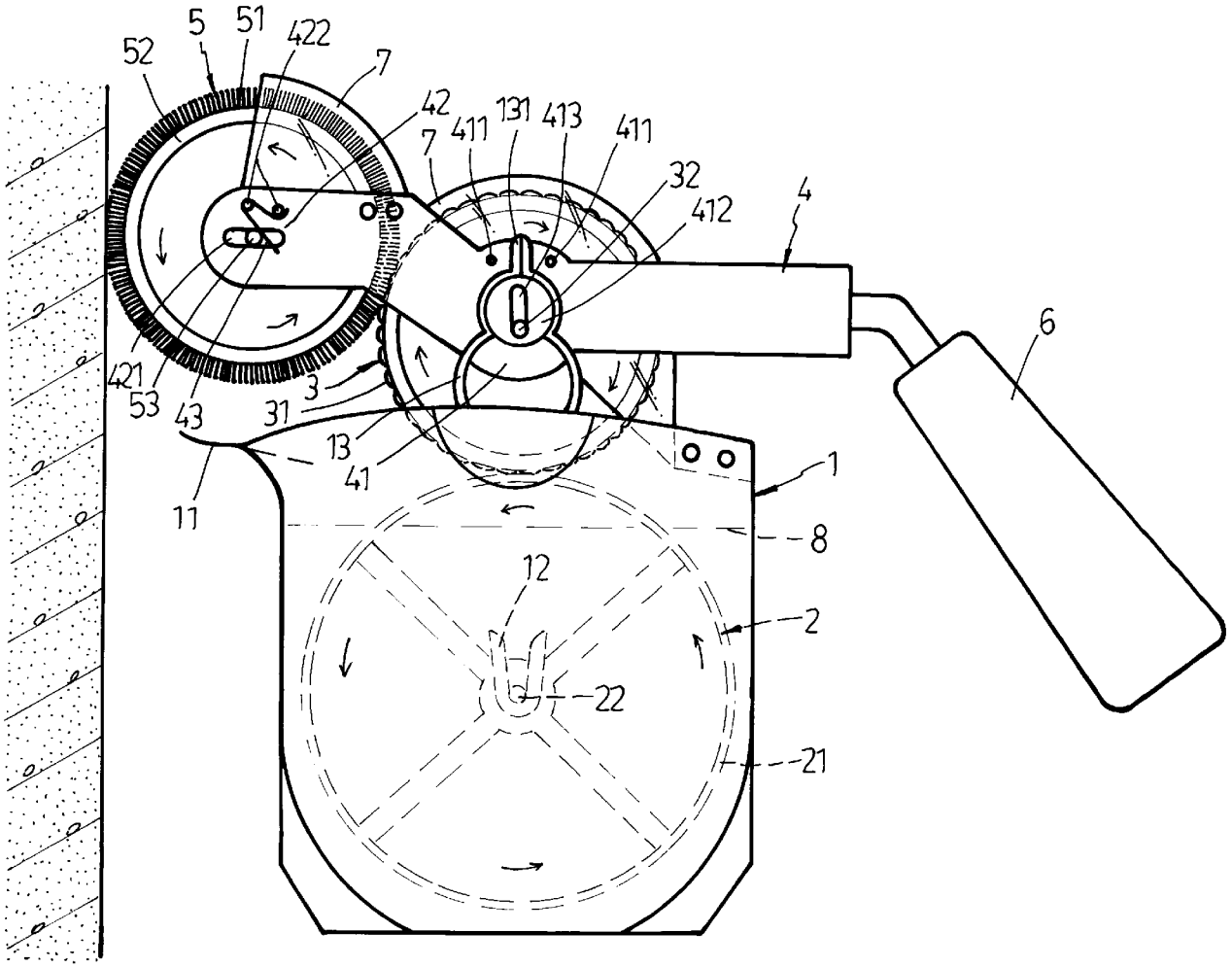
FIG. 5 is another applied view of the present invention, showing the painting roller pressed against the wall and turned.

Referring to FIG. 5 and FIG. 1 again, when the painting roller 5 is pressed against the wall to be paint, the painting roller 5 is forced into contact with the paint distribution roller 3, and the paint distribution roller 3 is forced into contact with the paint feeding roller 2. When moved over the wall, the longitudinally grooved roller cover 21 of the paint feeding roller 2 carry the paint 8 to the embossed roller cover 31 of the paint distribution roller 3, and the embossed roller cover 31 of the paint distribution roller 3 distribute the paint 8 over the felt cover layer 51 of the painting roller 5, permitting the paint 8 to be evenly applied to the wall. Further, two transparent fenders 7 are respectively pivoted to the pivots 53 of the painting roller 5 and the pivots 32 of the paint distribution roller 3 to protect against splashing paint.

Figure 6:
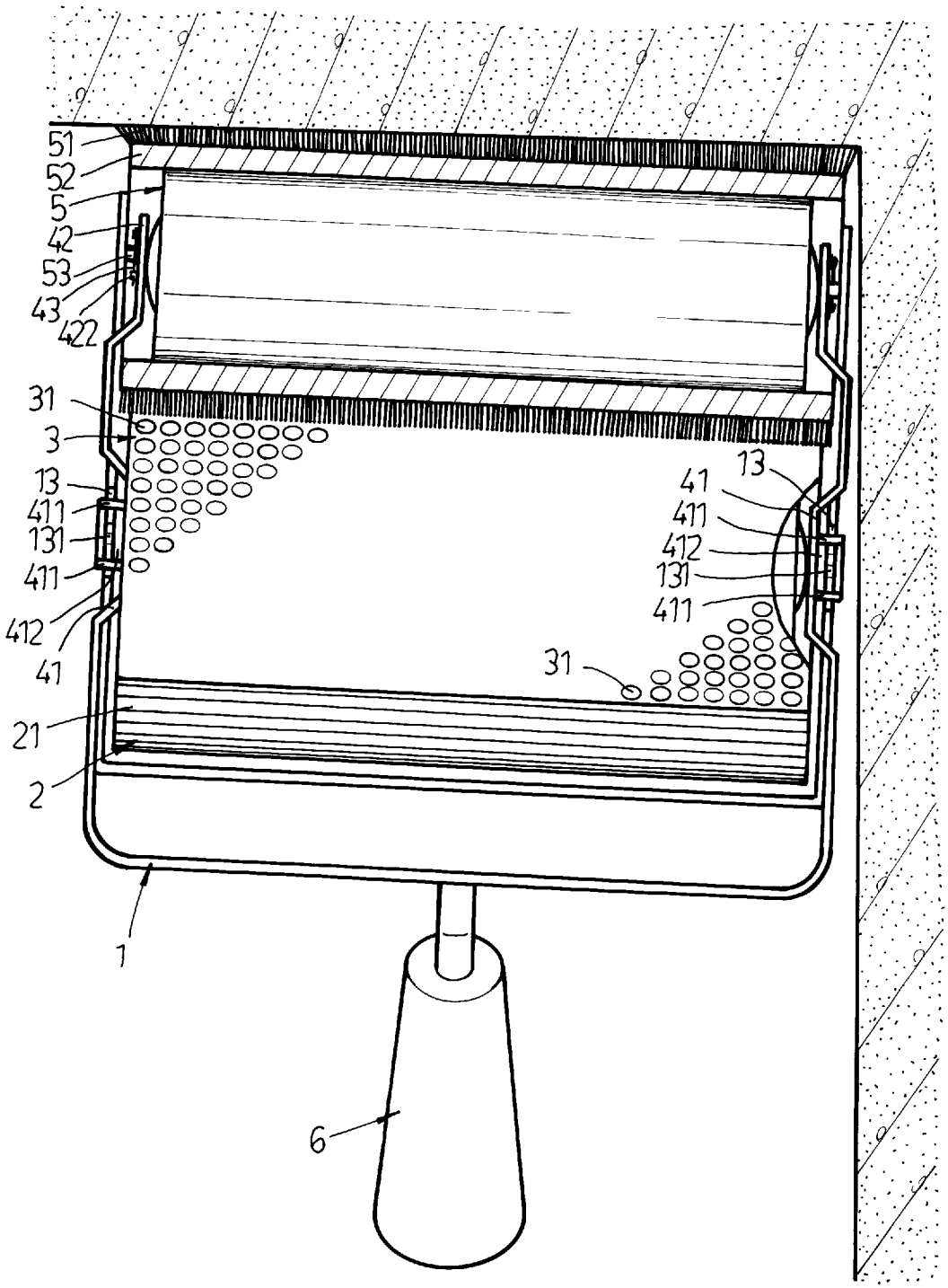
FIG. 6 is a sectional view taken along line 6—6 of FIG. 1.

Referring to FIG. 6, the two coupling end pieces 42 of the holder frame 4 are respectively bent inwards and clamped on two opposite ends of the painting roller 5 around the pivots 53; the foam cover 52 and its felt outside layer 51 project over the two opposite ends of the roller frame of the painting roller 5. The design of the painting roller 5 enables the paint roller device to effectively pain any corner area in the wall.

While only one embodiment of the present invention has been shown and described, it will be understood that various modifications and changes could be made thereunto without departing from the spirit and scope of the invention disclosed.

What the invention claimed is:

1. A paint roller device comprising a substantially U-shaped holder frame having two coupling end pieces, a handle fixedly connected to said U-shaped holder frame, a paint container coupled to said U-shaped holder frame and holding a paint, said paint container having two bearing blocks bilaterally disposed on the inside, a painting roller coupled to the two coupling end pieces of said U-shaped holder frame by two longitudinally extended oblong slots and adapted to apply said paint to the workpiece, a paint feeding roller revolvably supported between the bearing blocks inside said paint container and adapted to feed said paint to said painting roller, and a paint distribution roller coupled to said U-shaped holder frame by two transversely extended oblong slots and turned to distribute said paint from said paint feeding roller over said painting roller, wherein said U-shaped holder frame comprises two round rods symmetrically raised from two opposite sides thereof; and two pairs of locating pins symmetrically raised from its two opposite sides adjacent to said round rods; said paint container comprises two metal hangers revolvably hung on the round rods of said U-shaped holder frame, each of said metal hangers having a stop portion at a top side suspended between one pair of locating pins on said U-shaped holder frame to limit the turning angle of said paint container relative to said U-shaped holder frame; spring elements are coupled between said U-shaped holder frame and said painting roller to impart a forward pressure to said painting roller, causing said painting roller to be moved apart from said paint distribution roller; and said painting roller comprises a roller frame covered with a foam cover, said foam cover having a felt cover layer, said felt cover layer projecting over two opposite ends of said roller frame.

* * * * *